US007097667B2

(12) United States Patent
Reinhoudt et al.

(10) Patent No.: US 7,097,667 B2
(45) **Date of Patent: *Aug. 29, 2006**

(54) DRY CLEANING PROCESS

(75) Inventors: Hank Robert Reinhoudt, Viaardingen (NL); Jan Hendrik Theodoor Verbeek, Vlaardingen (NL)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/909,719

(22) Filed: Aug. 2, 2004

(65) Prior Publication Data

US 2005/0037938 A1 Feb. 17, 2005

(30) Foreign Application Priority Data

Aug. 11, 2003 (EP) ..... 03077503
Feb. 5, 2004 (EP) ..... 04075404

(51) Int. Cl.
*D06L 1/04* (2006.01)

(52) U.S. Cl. ..... 8/142

(58) Field of Classification Search ..... 8/137, 8/142, 158, 412

See application file for complete search history.

(56) References Cited

U.S. PATENT DOCUMENTS 3,360,474 A 12/1967 Cooley et al.
6,045,588 A * 4/2000 Estes et al. ..... 8/142
6,766,670 B1 * 7/2004 Estes et al. ..... 68/5 C
6,846,790 B1 * 1/2005 Evers et al. ..... 510/285

FOREIGN PATENT DOCUMENTS

GB 1 598 911 9/1981
WO 03/023127 A1 3/2003
WO 03/038179 A1 8/2003

OTHER PUBLICATIONS

*Copending Case No.*: Applicant: Reinhoudt et al., U.S. Appl. No. 10/909,720, filed Aug. 2, 2004, For: Dry Cleansing Process.

* cited by examiner

*Primary Examiner*—John R. Hardee
(74) *Attorney, Agent, or Firm*—Stephen Krefman; Robert O Rice; John F. Colligan

(57) ABSTRACT

The present invention provides a dry cleaning process for the in-home dry cleaning of laundry articles, comprising one or more cleaning steps followed by one or more rinse steps whereby at least one rinse step comprises contacting the laundry article with a rinse composition, said rinse composition comprising a low grade non-flammable non-chlorine containing organic dry cleaning solvent and said low grade solvent comprising at least 0.1 ppm and less than 50 000 ppm of squalene.

9 Claims, 1 Drawing Sheet

DRY CLEANING PROCESS

FIELD OF THE INVENTION

Figure 1:
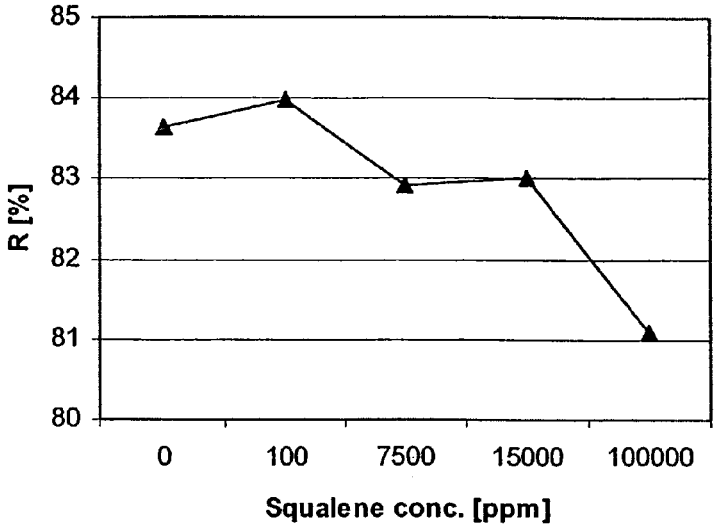

The present invention relates to a dry cleaning process, in particular for cleaning articles, especially laundry articles.

BACKGROUND OF THE INVENTION

Many alternative solvents have been proposed to replace perchloroethylene. Liquid carbon dioxide is one example, but the high-pressure equipment needed for this inorganic solvent makes it unpractical and prohibitively expensive. A novel and more promising class of dry cleaning solvents are the so-called non-flammable, non-chlorine containing organic solvents. Examples may include hydrofluoroethers such as nonafluoromethoxybutane and nonafluoroethoxybutane or hydrofluorocarbons as decafluoropentane. Hydrofluoroethers are relatively low in toxicity, are claimed to have zero ozone depletion potential, have relatively short atmospheric lifetimes, and can have very low global warming potentials relative to chloro fluorocarbons and many chloro fluorocarbon substitutes. Furthermore, HFEs are listed as non-volatile organic compounds by the EPA, and as such are not considered as smog precursors.

Some dry cleaning processes have been proposed for application in residential homes. However, commercialisation thereof has been hampered by the prohibitive costs of the amount of clean solvent that is needed. Some proposals have been made to purify the used solvent, e.g. WO-A-01/94679, to decrease the amount of clean solvent that is needed. But purification is cumbersome and requires complicated machinery. It is costly, time and energy consuming because all residues need to be removed before the solvent can be safely used for cleaning laundry. In addition, solid waste is generated which requires adequate disposal to protect the environment.

Therefore, there is a need for an improved dry cleaning process that solves one or more of the aforementioned problems.

Surprisingly, we have now found an improved dry cleaning process for the in-home dry cleaning of laundry articles that overcomes one or more of the above mentioned drawbacks provided that a low grade non-flammable non-chlorine containing organic dry cleaning solvent comprising squalene is used. Low grade is meant to describe a solvent comprising at least 0.1 ppm, preferably at least 1 ppm, more preferably at least 10 ppm and most preferably at least 50 ppm, and less than 50 000 ppm, preferably less than 25 000 ppm, more preferably less than 10 000 ppm of squalene. A squalene level in the low grade dry cleaning solvent of less than 5000 ppm is most preferred.

While low grade dry cleaning solvent comprises squalene, surprisingly it is still effective in cleaning textile articles without causing colour changes over time. Low grade dry cleaning solvent is easier and more cost effective to produce because less pure material is needed and fewer purification steps are needed. Low grade dry cleaning solvent can also be produced from used dry cleaning solvent without the time, energy and solid waste production associated with prior art purification processes.

DEFINITION OF THE INVENTION

Accordingly, in one aspect thereof the present invention provides a dry cleaning process for the in-home dry cleaning of laundry articles, comprising one or more cleaning steps followed by one or more rinse steps, whereby at least one rinse step comprises contacting the laundry articles with a rinse composition, said rinse composition comprising a low grade non-flammable non-chlorine containing organic dry cleaning solvent and said low grade solvent comprising at least 0.1 ppm, preferably at least 1 ppm and more preferably at least 10 ppm and less than 50 000 ppm, preferably less than 25 000 ppm, of squalene.

According to another embodiment, the invention provides a dry cleaning process for in-home freshening up of laundry articles, wherein said process does not comprise a dry cleaning step but one or more rinse step, wherein at least one rinse step comprises contacting the laundry articles with a rinse composition for freshening up laundry, said rinse composition comprising a low grade non-flammable, non-chlorine containing organic dry cleaning solvent including at least 0.1 ppm and less than 50 000 ppm of squalene, and optionally, but preferably, 0 to 20 wt. %, additives by weight of the total composition.

For simplicity the low grade non-flammable non-chlorine containing dry cleaning solvent will be referred to as low grade dry cleaning solvent. The low grade dry cleaning solvent preferably does not contain amounts of residues that could result in unacceptable damage and/or soiling of clothing or make it unsafe for use in an in-home application. However other compounds may be present in the low grade solvent such as glycerol tripalmitate, glycerol troleate, lauric acid, myristic acid, palmitic acid, oleic acid, linoleic acid, stearic acid, eicosane, tetracosane, stearyl stearate, oleyl oleate, cholesterol and mixtures thereof. Even small amounts of chromophores may be present as long as laundry articles can still be effectively cleaned.

The determination of the squalene in a dry cleaning solvent is a standard method available to the person skilled in the art. Preferably squalene is measured by gas chromatography.

DETAILED DESCRIPTION OF THE INVENTION

These and other aspects, features and advantages will become apparent to those of ordinary skill in the art from a reading of the following detailed description and the appended claims which present, by way of illustration, various exemplary modes contemplated for carrying out the invention. It is noted that the examples given in the description below are intended to clarify the invention and are not intended to limit the invention to those examples per se. Other than in the experimental examples, or where otherwise indicated, all numbers expressing quantities of ingredients or reaction conditions used herein are to be understood as modified in all instances by the term "about". Similarly, all percentages are weight/weight percentages of the total composition unless otherwise indicated. Numerical ranges expressed in the format "from x to y" are understood to include x and y. When for a specific feature multiple preferred ranges are described in the format "from x to y", it is understood that all ranges combining the different endpoints are also contemplated. Where the term "comprising" is used in the specification or claims, it is not intended to exclude any terms, steps or features not specifically recited. All temperatures are in degrees Celsius (° C.) unless otherwise specified. All measurements are in SI units unless otherwise specified.

Definitions

The term "dry cleaning process" used herein is intended to mean any process wherein laundry articles are contacted with a composition comprising dry cleaning solvent within a closable vessel. However, as used herein this term does not include any process comprising steps wherein the laundry articles are also immersed and rinsed in an aqueous cleaning composition comprising more than 80 wt. % water because this would damage garments that can only be dry cleaned.

The term "dry cleaning composition" as used herein is intended to mean the composition used in the dry cleaning process including the dry cleaning solvent, any surfactant, additives but excluding the laundry articles that are to be cleaned. The term "rinse composition" as used herein is intended to mean the composition used in the dry cleaning process to rinse out the soil and excess of any surfactant and/or additives of a previous process step. The rinse composition does not include the laundry articles.

The term "dry cleaning solvent" as used herein is intended to mean any non-aqueous organic solvent that preferably has a liquid phase at 20° C. and standard pressure. The term organic has its usual meaning, i.e., a compound with at least one carbon hydrogen bond.

When referring to the "weight of the cloth", it is intended to mean the weight of the cloth of the laundry article after the cloth has been equilibrated at 20° C., a relative humidity of 55% and standard pressure.

The term "laundry articles" as used herein is typically a garment but may include any textile article. Textile articles include—but are not limited to—those made from natural fibres such as cotton, wool, linen, hemp, silk and man made fibres such as nylon, viscose, acetate, polyester, polyamide, polypropylene elastomer, natural or synthetic leather, natural or synthetic fur and mixtures thereof. Although the term is used in plural form it is intended to encompass the singular.

The term "liquid to cloth ratio" (w/w) (LCR) as used herein is intended to mean the ratio of the weight of the total amount of dry cleaning or rinse composition to the weight of the cloth as defined above.

The term "immerse" as used herein is intended to mean that the laundry article is contacted with a cleaning effective amount of dry cleaning or rinse composition in a step of the dry cleaning process to wet the laundry article which is usually a LCR of greater than 0.5 or more preferably a LCR as given below.

The term "cleaning effective amount" as defined herein is intended to mean an amount effective to obtain the desired cleaning.

The term "in-home" as defined herein is intended to mean that the LCR of the dry cleaning step is at most 20. Although, the in-home dry cleaning is especially suitable for domestic homes, in some cases these small appliances may also be used in hotels, airports on a non-industrial scale.

The water content refers to water purposefully added to the laundry articles, for example as part of the dry cleaning composition as such or a pre-treatment composition, including hydrated water as part of ingredients making up these compositions. It is not intended to include the moisture of the untreated wash load e.g., a wet towel.

A dry cleaning process may comprise one or more cleaning steps followed by one or more rinse steps. During a cleaning step the laundry articles are contacted with a dry cleaning composition. The dry cleaning composition typically comprises cleaning effective amounts of surfactants and often additives. During a rinse step, the laundry articles are contacted with a rinse composition. The rinse step is typically used to rinse off any unwanted excess of e.g. surfactant and/or cleaning agent. Typically more than one rinse step is used, for example 2, 3 or 4 steps. The rinse composition usually consists essentially of low grade dry cleaning solvent. The rinse composition, in particular the final rinse composition, may however comprise additives that are useful in rinse steps such as, but not limited to, antibacterial agents, colorants, perfumes, pro-perfumes, finishing aids, composition malodour control agents, odour neutralisers, anti-tarnishing agents, anti-microbial agents, anti-oxidants, anti-redeposition agents, thickeners, abrasives, divalent or trivalent ions, metal ion salts, fabric softening agents, optical brighteners, hydrotropes, suds or foam suppressors, suds or foam boosters, anti-static agents, dye fixatives, dye abrasion inhibitors, anti-crocking agents, wrinkle reduction agents, wrinkle resistance agents, soil repellency agents, sunscreen agents, anti-fade agents, and mixtures thereof.

The low grade dry cleaning solvent is preferably used for the rinse steps since the rinse steps will be responsible for most of the solvent consumption of the dry cleaning process. In some cases, the low grade dry cleaning solvent may also be used for the cleaning steps. Thus according to one embodiment each composition used for the cleaning and rinse step of the inventive process comprises said low grade non flammable non-chlorine containing dry cleaning solvent.

We have found that the amount of rinse composition used to rinse a certain amount of laundry articles in a step of the dry cleaning process can be important. These amounts are expressed as the liquid to cloth ratio or LCR. Preferably the LCR is at most 20, more preferably at most 10, even more preferably at most 7 and preferably greater than 0.5, more preferably greater than 0.7, even more preferably greater than 1 and most preferably greater than 2.5. For the rinse step, the same LCR may be used wherein the "liquid" refers to the rinse composition which usually comprises only low grade dry cleaning solvent with optionally some additives. When the dry cleaning process comprises different steps, the LCR of each step may be different or the same. Preferably, the LCR of each step is as described above.

Usually, the rinse composition—including any soil and other unwanted residues—will be separated from the laundry articles after each rinse step. The separation may be carried out in several ways. Spinning, twisting, wringing, squeezing the laundry articles are well known mechanical ways. Thus according one preferred embodiment, a dry cleaning process provided whereby each rinse step is followed by separating the rinse composition from the textile article wherein the liquid to cloth ratio (w/w) after separation is less than 0.6, preferably less than 0.4, more preferably less than 0.2.

Following the separation step, the laundry articles may be dried in any conventional manner. For example, the laundry articles may be heated while being agitated in for example a drum or subjected to a low pressure to evaporate the dry cleaning solvent. It is preferred to dry the articles in way such that he evaporated solvent can be captured.

One or more rinse steps may be used in the dry cleaning process. Although it is highly preferred that the rinse composition for each rinse step comprises low grade dry cleaning solvent, the rinse composition for one or more rinse steps may comprise clean dry cleaning solvent. When more than one rinse step is used it is preferred that at least the final rinse step comprises contacting the laundry articles with a rinse composition, said rinse composition comprising a low grade dry cleaning solvent.

Dry Cleaning Solvent

The low grade dry cleaning solvent is usually a non-flammable, non-chlorine containing organic dry cleaning solvent. Although the term dry cleaning solvent is used in the singular, it should be noted that a mixture of solvents may also be used. Thus, the singular should be taken to encompass the plural, and vice versa. Because of the typical environmental problems associated with chlorine containing solvents, the solvent preferably does not contain Cl atoms. In addition, the solvent should not be flammable such as most petroleum or mineral spirits having typical flash points as low as 20° C. or even lower. The term non-flammable is intended to describe dry cleaning solvents with a flash point of at least 37.8° C., more preferably at least 45° C., most preferably at least 50° C. The limit of a flash point of at least 37.8° C. for non-flammable liquids is defined in NFPA 30, the Flammable and Combustible Liquids Code as issued by National Fire Protection Association, 1996 edition, Massachusetts USA. Preferred test methods for determining the flash point of solvents are the standard tests as described in NFPA30 2000 edition. One preferable class of solvents is a fluorinated organic dry cleaning solvent including hydrofluorocarbon (HFC) and hydrofluoroether (HFE). However even more preferred are non flammable non-halogenated solvents. For example other classes of suitable highly preferred solvents are siloxanes (see below). It should be noted that mixtures of different dry cleaning solvents may also be used.

The most desirable solvents are non-ozone depleting and a useful common definition for the ozone depleting potential is defined by the Environmental Protection Agency in the USA: the ozone depleting potential is the ratio of the impact on ozone of a chemical compared to the impact of a similar mass of CFC-11. Thus, the ODP of CFC-11 is defined to be 1.0.

Hydrofluorocarbons

One preferred hydrofluorocarbon solvent is represented by the formula CxHyF(2x+2−y), wherein x is from 3 to 8, y is from 1 to 6, the mole ratio of F/H in the hydrofluorocarbon solvent is greater than 1.6.

Preferably, x is from 4 to 6 and most preferred x is 5 and y is 2.

Especially suitable are hydrofluorocarbon solvents selected from isomers of decafluoropentane and mixtures thereof. In particular useful is 1,1,1,2,2,3,4,5,5,5-decafluoropentane. The E.I. Du Pont De Nemours and Company markets this compound under the name Vertrel XF™.

Hydrofluoroethers

Hydrofluoroethers (HFEs) suitable for use in the present invention are generally low polarity chemical compounds minimally containing carbon, fluorine, hydrogen, and catenary (that is, in-chain) oxygen atoms. HFEs can optionally contain additional catenary heteroatoms, such as nitrogen and sulphur. HFEs have molecular structures which can be linear, branched, or cyclic, or a combination thereof (such as alkylcycloaliphatic), and are preferably free of ethylenic unsaturation, having a total of about 4 to about 20 carbon atoms. Such HFEs are known and are readily available, either as essentially pure compounds or as mixtures.

Preferred hydrofluoroethers can have a boiling point in the range from about 40° C. to about 275° C., preferably from about 50° C. to about 200° C., even more preferably from about 50° C. to about 121° C. It is very desirable that the hydrofluoroether has no flashpoint. In general, when a HFE has a flash point, decreasing the F/H ratio or decreasing the number of carbon-carbon bonds each decreases the flash point of the HFE (see WO/00 26206).

Useful hydrofluoroethers include two varieties: segregated hydrofluoroethers and omega-hydrofluoroalkylethers. Structurally, the segregated hydrofluoroethers comprise at least one mono-, di-, or trialkoxy-substituted perfluoroalkane, perfluorocycloalkane, perfluorocycloalkyl-containing perfluoroalkane, or perfluorocycloalkylene-containing perfluoroalkane compound.

HFEs suitable for use in the processes of the invention include the following compounds:

C4F9OC2F4H
HC3F6OC3F6H
HC3F6OCH3
C5F11OC2F4H
C6F13OCF2H
C6F13OC2F4OC2F4H
c-C6F11CF2OCF2H
C3F7OCH2F
HCF2O(C2F4O)n(CF2O)mCF2H, wherein m=0 to 2 and n=0 to 3
C3F7O[C(CF3)2CF2O]pCFHCF3, wherein p=0 to 5
C4F9OCF2C(CF3)2CF2H
HCF2CF2OCF2C(CF3)2CF2OC2F4H
C7F15OCFHCF3
C8F17OCF2O(CF2)5H
C8F17OC2F4OC2F4OC2F4OCF2H
C4F9OC2H5
C4F9OCH3
C8F17OCH3

Preferred HFEs are according to the formula

CnX2n+1-O—CmY2 m+1

Wherein X and Y are each independently F or H provided that at least one F is present. Preferably, X═F and Y═H; n=2–15 and m=1–10, but preferably, n=3–8 and m=1–4, or more preferably n=4–6 and m=1–3.

Especially preferred is a HFE wherein n=4 and m=1 or 2 which is marketed under the name of HFE 7100™ and 7200™ respectively by the 3M corporation.

Mixtures of different organic dry cleaning solvents may also be used. For example, a suitable dry cleaning or rinse composition may comprise a mixture of HFEs together with a mixture of hydrocarbons and/or siloxanes When solvent compounds are mentioned, isomers thereof are also included. Thus, suitable HFEs include nonafluoromethoxybutane(C4F9OCH3) isomers such as 1,1,1,2,2,3,3,4,4-nonafluoro-4-methoxy-butane (CH3OCF2CF2CF2CF3), 1,1,1,2,3,3-hexafluoro-2-(trifluoromethyl)-3-methoxy-propane (CH3OCF2CF(CF3)2), 1,1,1,3,3,3-hexafluoro-2-methoxy-2-(trifluoromethyl)-propane(CH3OC(CF3)3), and 1,1,1,2,3,3,4,4,4-nonafluoro-2-methoxy-butane(CH3OCF(CF3)CF2CF3), approximate isomer boiling point=60° C.; Also isomers of nonafluoroethoxybutane (C4F9OC2H5) such as 1,1,1,2,2,3,3,4,4-nonafluoro-4-ethoxybutane(CH3CH2OCF2CF2CF2CF3), 1,1,1,2,3,3-hexafluoro-2-(trifluoromethyl)-3-ethoxypropane (CH3CH2OCF2CF(CF3)2), 1,1,1,3,3,3-hexafluoro-2-ethoxy-2-(trifluoromethyl)-propane (CH3CH2OC(CF3)3), and 1,1,1,2,3,3,4,4,4-nonafluoro-2-ethoxybutane (CH3CH2OCF(CF3)CF2CF3) with approximate isomer boiling points of 73° C.

Siloxane Dry Cleaning Solvent

Some siloxane solvents may also be used advantageously in the present invention. The siloxane may be linear, branched, cyclic, or a combination thereof. One preferred branched siloxane is tris (trimethylsiloxyl) silane. Also preferred are linear and cyclic oligo dimethylsiloxanes are preferred. One preferred class of siloxane solvents is an alkylsiloxane represented by the formula R3-Si(—O—SiR2)w-R Where each R is independently chosen from an alkyl group having form 1 to 10 carbon atoms and w is an integer from 1 to 30. Preferably, R is methyl and w is 1–4 or even more preferably w is 3 or 4.

Of the cyclic siloxane octamethyl cyclotetrasiloxane and decamethyl cyclopentasiloxane are particularly effective.

Very useful siloxanes are selected from the group consisting of decamethyl tetrasiloxane, dodecamethyl pentasiloxane and mixtures thereof.

Preferably, the organic solvent is not a terpene. Especially suitable organic dry cleaning solvents include those selected from the group consisting of the isomers of nonafluoromethoxybutane, nonafluoroethoxybutane and decafluoropentane, octamethyl cyclotetrasiloxane, decamethyl cyclopentasiloxane, decamethyl tetrasiloxane, dodecamethyl pentasiloxane and mixtures thereof. Even more preferred are organic dry cleaning solvents include those selected from the group consisting of octamethyl cyclotetrasiloxane, decamethyl cyclopentasiloxane, decamethyl tetrasiloxane, dodecamethyl pentasiloxane and mixtures thereof.

The dry cleaning compositions of the invention generally contain greater than about 50 percent by weight of organic dry cleaning solvent, preferably greater than about 75 weight percent, more preferably greater than about 80 weight percent, more preferably greater than about 85 weight percent, even more preferably greater than about 95 weight percent, but preferably less than 100 weight percent of organic dry cleaning solvent by weight of the total dry cleaning composition. Such amounts aid in improved drying times and maintain a high flash point or no flash point at all.

Preferably, at least part of the low grade dry cleaning solvent has been obtained by treating used solvent with a non-distillative/non-sorptive process. The used solvent may have been applied in a previous cleaning step or rinse step, either as part of the same dry cleaning process or even from a previous dry cleaning process.

A non-distillative/non-sorptive process has the advantage of being more cost effective and less time consuming than processes comprising distillation steps, absorption and/or adsorption steps. In addition, a non-distillative/non-sorptive process produces less solid waste.

Thus, according preferred embodiment low grade solvent has been obtained by treating solvent used for a previous step in a dry cleaning process with a non-distillative/non-sorptive process.

Non-distillative/non-sorptive processes include but are not limited to extraction, gravity separation, dialysis, electrodialysis, diafiltration, filtration, pervaporation, crystallisation, centrifugation, sedimentation, air stripping, desiccant drying, chemical addition, enzymatic, microbial, or bacterial addition, temperature modification, electrostatic coalescence and combinations thereof.

Extraction is the selective transfer of a compound or compounds from one liquid to another immiscible liquid or from a solid to a liquid. The former process is called a liquid-liquid extraction and is an indirect separation technique because two components are not separated directly. A foreign substance, an immiscible liquid is introduced to provide a second phase.

"Decantation" and "density gradation" are gravity-type separation methods. A "decanter" is defined as a vessel used to separate a stream continuously into two liquid phases using the force of gravity. Using Stokes' law, one can derive the settling velocity of the droplets in the continuous phase and design a decanter accordingly.

Dialysis is the transfer of solute through a membrane as a result of a transmembrane gradient in the concentration of the solute. It is accompanied by osmosis, which is a transfer of a solvent through a membrane as a result of a transmembrane gradient in the concentration of the solvent. The direction of a solute transfer in dialysis is opposite that of solvent transfer in osmosis. Dialysis is effective in the removal of low molecular weight solute molecules or ions from a solution via their passage through a semi-permeable membrane driven by a concentration gradient.

Electrodialysis is a process whereby the electrolytes are transferred through a system of solutions and membranes by an electrical driving force. As currently used, the term electrodialysis refers to a multiple-compartment electrodialysis with ion-exchange membranes. There are four variations of electrodialysis: electrolytic, concentration diluting, ion substitution, and reversal.

Diafiltration differs from conventional dialysis in that the rate of micro species removal is not dependent on concentration but is simply a function of the ultrafiltration rate (membrane area) relative to the volume to be exchanged or dialysed. Repeated or continuous addition of fresh solvent flushes out or exchanges salts and other micro species efficiently and rapidly.

Filtration is the separation of a matter/fluid mixture involving passage of most of the fluid through a porous barrier which retains most of the dissolved and/or dispersed matter contained in the mixture.

Solids can be designed to adsorb water while rejecting solvents. Likewise, membranes can be designed to pass water and retain solvents or vice versa. The use of pervaporation for removing water from solvent-water mixtures involves the use of a hydrophilic membrane. The removal of solvents from water is identical except for the use of a membrane that rejects water but is lipophilic.

Crystallisation is the process of producing crystals from a vapour, a melt, or a solution and is distinguished from precipitation in that the latter usually exhibits extremely high levels of super-saturation, primary nucleation, and low solubility ratios.

Centrifugation is a technique that separates materials based upon differences in density, the rate of separation being amplified by applying increasing rotational force. The force is called a centrifugal force and the apparatus providing the rotational force is called a centrifuge.

Sedimentation is the separation of suspended solid particles from a liquid stream via gravitational settling. Sedimentation can also be used to separate solid particles based on differences in their settling rates.

Air stripping is a method whereby many organic solvents can be removed from wastewater to a level at which the water can be discharged. This method applies particularly to solvents that have a low solubility in water or a high volatility relative to water.

Desiccant drying involves bringing a water-wet solvent into contact with a solid, usually an electrolyte, suited to withdraw the water and form a second phase. Water can then be removed from this second phase by other means (e.g. decantation).

Chemical addition involves the addition of chemicals to change at least one physico-chemical property of the liquid such as pH, ionic strength, etceteras. Examples of these chemicals include salts, acids, bases, coagulants, and flocculants.

Enzymatic, microbial, or bacterial addition involves the addition of enzymes, microbes, or bacteria to a waste stream to remove organic contaminants from the stream.

Temperature modification enhances the separation of mixtures and can include both cooling and/or heating of the mixture. Increasing the temperature of the mixtures aids coalescence while cooling aids the crystallisation or freezing of one of the components.

Electrostatic coalescence involves exposing an emulsion containing two mutually insoluble phases (for example lipophilic fluid and water), wherein one phase is the continuous phase and the other is the discontinuous phase, to an electric field to affect coalescence of the discontinuous phase into droplets of a large enough size such that the droplets gravitate from the emulsion based on the density difference of the two phases. In order to carry this method out, the two phases must have at least a minor difference in dielectric constants and densities. Electric coalescence is a well-known process and is described in U.S. Pat. No. 3,207,686 to Jarvis et al.; U.S. Pat. No. 3,342,720 to Turner; U.S. Pat. No. 3,772,180 to Prestridge; U.S. Pat. No. 3,939,395 to Prestridge; U.S. Pat. No. 4,056,451 to Hodgson; U.S. Pat. No. 4,126,537 to Prestridge; U.S. Pat. No. 4,308,127 to Prestridge; and U.S. Pat. No. 5,861,089 to Gatti et al.

The Dry Cleaning Process

The rinse composition may be used in a dry cleaning process as described below.

The dry cleaning process may comprise different steps in any order depending on the desired outcome. The number and length of steps for e.g., cleaning, rinsing, conditioning steps may depend on the desired outcome. Each step may preferably last from at least 0.1 min, or preferably at least 0.5 min or more preferably at least 1 min or even 5 min, and at most 2 hrs, preferably at most 30 min, even more preferably at most 20 min and in some instances at most 5 min. In some cases longer times may be desired for example overnight.

Generally, articles such as clothing are cleaned by contacting a cleaning effective amount of the dry cleaning composition according to one aspect of the invention with the articles for an effective period of time to clean the articles or otherwise remove stains. Preferably, the laundry articles are immersed in the dry cleaning or rinse composition. The amount of dry cleaning or rinse composition used and the amount of time the composition contacts the article can vary based on equipment and the number of articles being cleaned. Normally, the dry cleaning process will comprise at least one step of contacting the article with a dry cleaning composition according to one aspect of the invention and at least one step of rinsing the article as described above. The rinse composition will usually comprise of mainly solvent but additives may be added as desired.

Typically, each step comprises contacting the laundry articles with a composition tailored for that step, e.g. a dry cleaning composition for a cleaning step, a rinsing composition for a rinsing step. The last rinsing step may also be used for conditioning when the composition comprises conditioning agents while it also rinses off any unwanted residues e.g. soil or surfactants. A step will normally comprise contacting the laundry articles with a composition, agitating the laundry articles in the composition, removing the composition from the laundry articles as mentioned previously.

The laundry articles in need of treatment are placed inside a closable vessel. It will be clear that the process is also suitable for cleaning one laundry article at the time although it will often be more efficient to clean more articles at the same time. Preferably, the vessel is a rotatable drum as part of an automated dry cleaning machine that is closed or sealed in such a way that the dry cleaning solvent can be contained within the machine if needed. Inside the vessel, the laundry articles are then contacted with the dry cleaning composition. This may be done in any way known in the art such as spraying or even using a mist.

In some cases it may be useful to formulate the composition for one of the steps in the dry cleaning process in situ in the drum by contacting the different ingredients of the composition separately with the laundry articles. For example—when the dry cleaning composition comprises dry cleaning solvent, water and surfactant—first water, then surfactant followed by the dry cleaning solvent. Or first the dry cleaning solvent, followed by the surfactant and then water. Or any other order.

Alternatively, two or more of the ingredients may be premixed before they are contacted with the laundry articles. For example, water and surfactant may be premixed and this premix is then contacted with the laundry followed by the dry cleaning solvent. In the alternate, dry cleaning solvent and surfactant may be premixed and this premix is then contacted with the laundry followed by water.

Thus, in one preferred aspect, in situ formulation of the dry cleaning composition may also be provided by incorporating one or more ingredients of the dry cleaning composition into a pre-treatment composition, pretreating the laundry articles with the pre-treatment composition, contacting the laundry articles with the remaining ingredients of the dry cleaning composition thereby formulating the dry cleaning composition in situ. This pre-treatment may take place manually outside the drum or mechanically inside the drum as part of a pre-treatment step. The pre-treatment step per se need not be immersive, i.e., it may be limited to treating the stained areas only provided that when the laundry articles are contacted with all the ingredients making up the final dry cleaning composition, the laundry articles are immersed in said dry cleaning composition. For example—when the dry cleaning composition comprises of dry cleaning solvent, water and surfactant—stained areas of the laundry articles may be pre-treated with a premix of water and surfactant manually or by an automated process. After effective pre-treatment time is allowed, the laundry articles may be contacted in the drum with the remaining ingredients such as in this case, the dry cleaning solvent (and optionally the remaining amounts of water and cleaning agent) to result in situ in the dry cleaning composition according to this aspect of the invention. The pre-treatment time will be at least 5 sec but could be less than 1 day, preferably less than 1 hr, more preferably less than 30 min. The pre-treatment composition may be formulated to treat specific stains. For example cleaning effective amounts of protease and other enzymes may be included to treat proteinacious stains.

In another preferred embodiment, the complete dry cleaning composition is premixed in a separate premix compartment. For example, when the dry cleaning composition comprises dry cleaning solvent, surfactant and water, these may be premixed in a separate compartment before the dry cleaning composition is contacted with the laundry articles. Preferably such a premix is in the form of an emulsion or micro-emulsion. Forming a premix of for example a water-in-oil emulsion can be brought about by any number of suitable procedures. For example, the aqueous phase containing a cleaning effective amount of surfactant package can be contacted with the solvent phase by metered injection just prior to a suitable mixing device. Metering is preferably maintained such that the desired solvent/water ratio remains relatively constant. Mixing devices such as pump assemblies or in-line static mixers, a centrifugal pump or other type of pump, a colloid mill or other type of mill, a rotary mixer, an ultrasonic mixer and other means of dispersing one liquid in another, non-miscible liquid can be used to provide effective agitation to cause emulsification.

These static mixers are devices through which the emulsion is passed at high speed and in which said emulsion experiences sudden changes in direction and/or in the diameter of the channels which make up the interior of the mixers. This results in a pressure loss, which is a factor in obtaining a correct emulsion in terms of droplet size and stability.

In one variant of the method of the invention, the mixing steps are for example sequential. The procedure consists in mixing the solvent and emulsifier in a first stage, the premix being mixed and emulsified with the water in a second stage.

In another variant of the method of the invention, provision is made for carrying out the above steps in a continuous mode.

The premix may take place at room temperature, which is also the temperature of the fluids and raw materials used.

A batch process such as an overhead mixer or a continuous process such as a two fluid co-extrusion nozzle, an in-line injector, an in-line mixer or an in-line screen can be used to make the emulsion. The size of the emulsion composition in the final composition can be manipulated by changing the mixing speed, mixing time, the mixing device and the viscosity of the aqueous solution. In general, by reducing the mixing speed, decreasing the mixing time, lowering the viscosity of the aqueous solution or using a mixing device that produces less shear force during mixing, one can produce an emulsion of a larger droplet size. Especially preferred are ultrasonic mixers. Although the description above refers to the addition of surfactant it is understood it may also apply to the addition of additives to e.g. the rinse composition.

While the laundry articles are in contact with the dry cleaning solvent, it is preferred to add mechanical energy for example by agitating or tumbling the laundry articles by rotating the drum or other means known in the art. Usually after one step, the dry cleaning solvent including any additives and/or loosened soil will be separated from the laundry articles as described above.

In other instances it may be advantageous to recirculate at least part of the dry cleaning composition during one step. For example by separating a portion of the dry cleaning composition from the laundry articles, optionally filtering soil from the separated portion of dry cleaning composition and contacting the laundry articles with the filtered portion of the dry cleaning composition.

The surfactants, dry cleaning solvents, cosolvents and optional additives used in present invention are described below and may be the same or different for each step of the inventive process.

The dry cleaning is usually performed at atmospheric pressure and room temperature, between 10 and 30° C. in most countries. In some instances the process temperature may be elevated to just under the boiling point of the most volatile dry cleaning solvent used. Preferably, the at least one rinse step is carried out between 0 and 70° C. Sometimes the process may be performed under reduced or elevated pressure, typically achieved via a vacuum pump or by supplying a gas, such as nitrogen, to the apparatus thereby increasing the pressure the closable vessel. The dry cleaning process may be carried out in any suitable apparatus. Preferably, the apparatus will comprise a closable vessel and means to recycle the dry cleaning solvents used to minimise solvent losses into the environment. The dry cleaning composition may be in the form of a micro-emulsion but usually will be in the form of a macro-emulsion, which is generally accepted to be thermodynamically unstable. A suitable process and appliance for dry cleaning is described in U.S. Pat. No. 6,045,588. The solvent will preferably be filtered and recycled in the same appliance. Generally, the laundry articles will be agitated in the dry cleaning process by tumbling, rotating, ultrasonics or any suitable type of mechanical energy (see U.S. Pat. No. 6,045,588).

Sometimes clothes do not need removing stains or soil but need only to be freshened up. Accordingly, in yet another preferred embodiment, the low grade dry cleaning solvent may be used in a dry cleaning process for freshening up laundry. In this embodiment the dry cleaning process does not comprise a dry cleaning step i.e., a cleaning step comprising amounts of surfactant and/or cleaning agent(s) that are so high that these need to be rinsed out in a subsequent rinsing step. Such a process may comprise at least one rinse step wherein the rinse composition for freshening up laundry comprises low grade dry cleaning solvent and optionally, but preferably, additives as described below. Preferably, the additives are selected from perfume, agent pro-perfumes, finishing aids, composition malodour control agents, odour neutralisers, polymeric dye transfer inhibiting agents, anti-tarnishing agents, anti-microbial agents, anti-oxidants, anti-redeposition agents, soil release polymers, electrolytes, pH modifiers, thickeners, fabric softening agents, optical brighteners, fabric softeners, anti-static agents, dye fixatives, dye abrasion inhibitors, anti-crocking agents, wrinkle reduction agents, wrinkle resistance agents, soil repellency agents, sunscreen agents, anti-fade agents, and mixtures thereof. The amount of additives is as described below and one or more rinse steps may be used with only dry cleaning solvent, preferably low grade dry cleaning solvent. Preferably the amounts are so low that no additional rinse steps are needed. Thus in the latter case the dry cleaning process for freshening up laundry comprises only one step of contacting the laundry articles with said rinse composition.

Water

In some cases water may be used in the dry cleaning steps and the amount of water is important. In those cases, the amount of water present in any step of the dry cleaning process is at such a level that laundry articles can be safely cleaned. This includes laundry articles that can only be dry cleaned. The amount of water present in a low aqueous dry cleaning composition is preferably from 0.01 to 50 wt. % water more preferably from 0.01 to 10 wt. %, even more preferably from 0.01 to 0.9 wt. % water by weight of the dry cleaning composition or more preferably, 0.05 to 0.8 wt. % or most preferable 0.1 to 0.7 wt. %. The amount of water present in a non-aqueous dry cleaning composition is preferably from 0 to 0.1 wt. % water by weight of the dry cleaning composition or more preferably, 0 to 0.01 wt. % or even more preferable 0 to 0.001 wt. % and most preferable 0 wt. %. When the dry cleaning composition comprises water, preferably the water to cloth ratio (w/w) (WCR) is less than 0.45, more preferably less than 0.35, more preferably less than 0.25, more preferably less than 0.2, most preferably less than 0.15, but usually more than 0.0001, preferably more than 0.001, more preferably more than 0.01.

When the dry cleaning process comprises more than one step, this WCR preferably applies to all steps in the dry cleaning process, especially when the dry cleaning composition comprises water and solvent. However, the WCR may or may not differ for each step. It is also preferred that this WCR applies to each step in the dry cleaning process wherein the LCR is more than 1.

Cosolvents

The compositions of the invention may contain one or more cosolvents. The purpose of a cosolvent in the dry cleaning compositions of the invention is often to increase the solvency of the dry cleaning composition for a variety of soils. However, if a cosolvent is used the dry cleaning composition is preferably a non-azeotrope as azeotropes may be less robust.

Useful cosolvents of the invention are soluble in the dry cleaning solvent or water, are compatible with typical additives, and can enhance the solubilisation of hydrophilic composite stains and oils typically found in stains on clothing, such as vegetable, mineral, or animal oils. Any cosolvent or mixtures of cosolvents meeting the above criteria may be used.

Useful cosolvents include alcohols, ethers, glycol ethers, alkanes, alkenes, linear and cyclic amides, perfluorinated tertiary amines, perfluoroethers, cycloalkanes, esters, ketones, aromatics, the fully or partly halogenated derivatives thereof and mixtures thereof. Preferably, the cosolvent is selected from the group consisting of alcohols, alkanes, alkenes, cycloalkanes, ethers, esters, cyclic amides, aromatics, ketones, the fully or partly halogenated derivatives thereof and mixtures thereof.

Representative examples of cosolvents which can be used in the dry cleaning compositions of the invention include methanol, ethanol, isopropanol, t-butyl alcohol, trifluoroethanol, pentafluoropropanol, hexafluoro-2-propanol, methyl t-butyl ether, methyl t-amyl ether, propylene glycol n-propyl ether, propylene glycol n-butyl ether, dipropylene glycol n-butyl ether, propylene glycol methyl ether, ethylene glycol monobutyl ether, trans-1,2-dichloroethylene, decalin, methyl decanoate, t-butyl acetate, ethyl acetate, glycol methyl ether acetate, ethyl lactate, diethyl phthalate, 2-butanone, N-alkyl pyrrolidone (such as N-methylpyrrolidone, N-ethyl pyrrolidone), methyl isobutyl ketone, naphthalene, toluene, trifluorotoluene, perfluorohexane, perfluoroheptane, perfluorooctane, perfluorotributylamine, perfluoro-2-butyl oxacyclopentane.

Preferably, the cosolvent is present in the compositions of the invention in an effective amount by weight to form a homogeneous composition with the other dry cleaning solvent(s) such as HFE. The effective amount of cosolvent will vary depending upon which cosolvent or cosolvent blends are used and the other dry cleaning solvent(s) used in the composition. However, the preferred maximum amount of any particular cosolvent present in a dry cleaning composition should be low enough to keep the dry cleaning composition non-flammable as defined above.

In general, cosolvent may be present in the compositions of the invention in an amount of from about 1 to 50 percent by weight, preferably from about 5 to about 40 percent by weight, and more preferably from about 10 to about 25 percent by weight. In some exceptional cases the cosolvent may be present amounts of from about 0.01 percent by weight of the total dry cleaning composition.

Surfactants

The dry cleaning compositions of the invention can utilise many types of cyclic, linear or branched surfactants known in the art, both fluorinated and non-fluorinated. Preferred solvent compatible surfactants include nonionic, anionic, cationic and zwitterionic surfactants having at least 4 carbon atoms, but preferably less than 200 carbon atoms or more preferably less than 90 carbon atoms. Preferred surfactants are described in pending application EP 02080470.4.

These and other surfactants suitable for use in combination with the organic dry cleaning solvent as adjuncts are well known in the art, being described in more detail in Kirk Othmer's Encyclopaedia of Chemical Technology, 3rd Ed., Vol. 22, pp. 360–379, "Surfactants and Detersive Systems". Further suitable nonionic detergent surfactants are generally disclosed in U.S. Pat. No. 3,929,678, Laughlin et al., issued Dec. 30, 1975, at column 13, line 14 through column 16, line 6. Other suitable detergent surfactants are generally disclosed in WO-A-0246517.

The surfactant or mixture of surfactants is present in a cleaning effective amount. A cleaning effective amount is the amount needed for the desired cleaning. This will, for example, depend on the number of articles, level of soiling and volume of dry cleaning composition used. However, surprisingly effective cleaning was observed when the surfactant was present from at least 0.001 wt. % to 10 wt. % by weight of the dry cleaning composition. More preferably, the surfactant is present from 0.01 to 3 wt. % or even more preferably from 0.05 to 0.9 wt. % by weight of the dry cleaning composition. More preferably, the surfactant is present from 0.1 to 0.8 wt. % or even more preferably from 0.3 to 0.7 wt. % by weight of the dry cleaning composition.

Surprisingly, it was found that the surfactant to cloth ratio (w/w) (SCR) was important in many cases to obtain an effective cleaning while maintaining a good garment care. Preferably, the SCR is at most 0.25, more preferably at most 0.12, more preferably at most 0.08, more preferably at most 0.04, but preferably at least 0.0001, more preferably at least 0.0003, more preferably at least 0.001 and most preferably at least 0.002.

Optional Additives

The compositions in the inventive process may contain one or more optional additives. Additives include any agent suitable for enhancing the cleaning, appearance, condition and/or garment care. Generally, the cleaning agent may be present in the compositions of the invention in an effective amount or preferably of about 0 to 20 wt. %, preferably 0.001 wt. % to 10 wt. %, more preferably 0.01 wt. % to 2 wt. % by weight of the total composition.

Some suitable additives include, but are not limited to, builders, enzymes, bleach activators, bleach catalysts, bleach boosters, bleaches, alkalinity sources, antibacterial agents, colorants, perfumes, pro-perfumes, finishing aids, lime soap dispersants, composition malodour control agents, odour neutralisers, polymeric dye transfer inhibiting agents, crystal growth inhibitors, photobleaches, heavy metal ion sequestrants, anti-tarnishing agents, anti-microbial agents, anti-oxidants, anti-redeposition agents, soil release polymers, electrolytes, pH modifiers, thickeners, abrasives, divalent or trivalent ions, metal ion salts, enzyme stabilisers, corrosion inhibitors, diamines or polyamines and/or their alkoxylates, suds stabilising polymers, process aids, fabric softening agents, optical brighteners, hydrotropes, suds or foam suppressors, suds or foam boosters, fabric softeners, anti-static agents, dye fixatives, dye abrasion inhibitors, anti-crocking agents, wrinkle reduction agents, wrinkle resistance agents, soil repellency agents, sunscreen agents, anti-fade agents, and mixtures thereof.

The invention is illustrated by the following non-limiting examples.

EXAMPLE 1

A number of white cotton cloths were cut and dipped in octamethyl cyclotetrasiloxane (L4), as dry cleaning solvent, containing various concentrations of squalene. The concentrations of squalene in the L4 solvent were 0, 11, 7500, 15 000 and 100 000 ppm.

Subsequently, these dipped cloths were centrifuged using a table centrifuge during 10 minutes at a speed of 2000 rpm. After this centrifuging step, solvent retention values (in the cloth) of between 0.11 and 0.16 were observed, expressed as the weight of the retaining solvent divided by the weight of the dry cloth. Thereafter, the test cloth were connected to a tea towel and hung in ambient room air, but not in open sun light. The test cloth were stored in this way for more than 3 months. After 100 days of storage, the reflectance (R) at 480 nm of these test cloths was measured. The results are given in FIG. 1, showing the relationship between reflectance value and squalene concentration.

It can be clearly observed that at higher squalene concentrations lower reflectance values were measured.

It is noted in this connection that an absolutely clean white cotton cloth has a reflectance (R) of approximately 85%, while a reflectance of 100% represents a surface which reflects all incoming light energy.

Visually, it was observed that the cloths which were treated with 100 000 ppm squalene (in L4 dry cleaning solvent) solution have build up an unacceptable discoloration (i.e. yellowing) after 100 days of storage in ambient air. All other test cloths (which were dipped in solvent solutions containing the indicated lower concentrations of squalene) were observed to be white; i.e. no observable discoloration has taken place on these test cloths.

EXAMPLE 2

An additional series of measurements was carried out using test cloths which were dipped in two different types of dry cleaning solvents containing the various level concentrations of squalene. As dry cleaning solvents, octamethyl cyclotetrasiloxane (L4) and decamethyl cyclopentasiloxane (D5) were used. The concentrations of squalene in these dry cleaning solvents were: 15 000, 30 000, 60 000 and 100 000 ppm.

Figure 2:
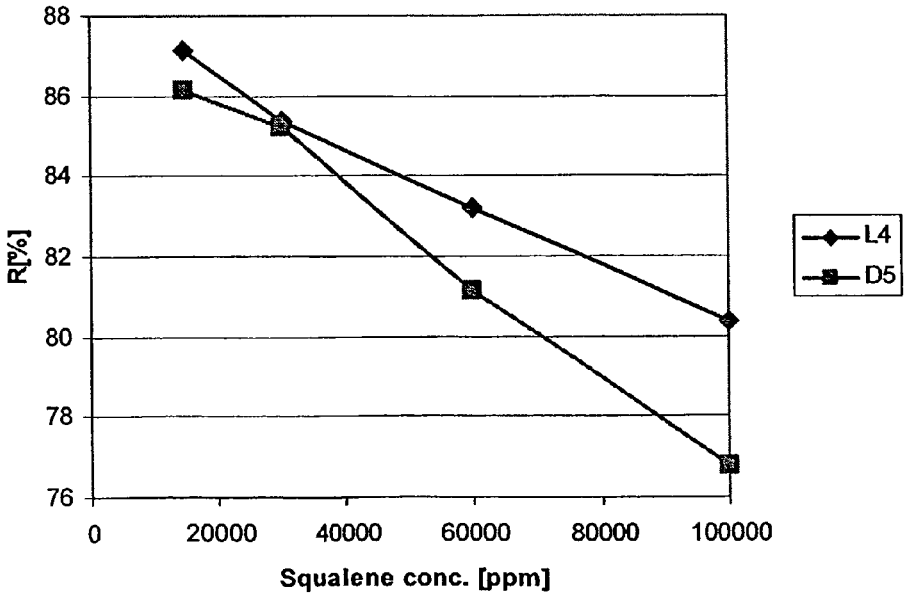

In this example, the dipped test cloths were centrifuged and stored in the same as in example 1. After 100 days of storage, the reflectance (R) at 480 nm was measured The results are given in FIG. 2, showing the relationship between reflectance value and squalene concentration for the two solvents applied. When observing these results, it can be noticed that the reflectance values for the same squalene levels are generally somewhat higher than those found in example 1. The reason may be a different location of storage for this second series of test cloths. This may also be caused by the fact that discoloration is a dynamic process and that the speed thereof is slightly variable.

It was observed that the whiteness of the test cloths which were treated with 30.000 ppm squalene or lower (in either L4 or D5 dry cleaning solvent) was just acceptable: hardly any discoloration had taken place on these test cloths. On the other hand, the test cloths which were treated with 60 000 ppm and 100 000 ppm squalene had clearly build up an unacceptable discoloration (i.e. yellowing) after 100 days of storage.

The invention claimed is:

1. A dry cleaning process for the in-home dry cleaning of laundry articles comprising one or more cleaning steps followed by one or more rinse steps whereby at least one rinse step comprises contacting the laundry article with a rinse composition, said rinse composition comprising a low grade non-flammable non-chlorine containing organic dry cleaning solvent and said low grade solvent comprising at least 0.1 ppm and less than 50 000 ppm of squalene.

2. A process according to claim 1, wherein the low grade dry cleaning solvent is non-halogenated.

3. A process according to claim 1, wherein the liquor to cloth ratio (w/w) during at least one rinse step is at most 20 and greater than 0.5.

4. A process according to claim 1, wherein at least one rinse step is carried out between 0 and 70° C.

5. A process according to claim 1, wherein at least the final rinse step comprises contacting the laundry articles with said rinse composition.

6. A process according to claim 1, wherein each rinse step is followed by separating the rinse composition from the textile article wherein the liquid to cloth ratio (w/w) after separation is less than 0.6, preferably less than 0.4, more preferably less than 0.2.

7. A process according to claim 1, wherein each composition used for the cleaning and rinse step comprises said low grade dry cleaning solvent.

8. A process according to claim 1, wherein at least part of the low grade dry cleaning solvent has been obtained by treating used solvent with a non-distillative/non-sorptive process.

9. A process according to claim 1, wherein the low grade dry cleaning solvent is selected from the group consisting of the isomers of nonafluoromethoxybutane, nonafluoroethoxybutane and decafluoropentane, octamethyl cyclotetrasiloxane, decamethyl cyclopentasiloxane, decamethyl tetrasiloxane, dodecamethyl pentasiloxane and mixtures thereof.

* * * * *

UNITED STATES PATENT AND TRADEMARK OFFICE

CERTIFICATE OF CORRECTION

PATENT NO. : 7,097,667 B2
APPLICATION NO. : 10/909719
DATED : August 29, 2006
INVENTOR(S) : Reinhoudt et al.

It is certified that error appears in the above-identified patent and that said Letters Patent is hereby corrected as shown below:

On the title page, item (75), add the following inventors:

-- Joel A. Luckman; Brian W. May; Vicki Lyn Wyatt; Mark B. Kovich; Tremitchell Wright and Daniel C. Conrad. --

Signed and Sealed this
Twenty-third Day of August, 2011

David J. Kappos

David J. Kappos
*Director of the United States Patent and Trademark Office*